United States Patent [19]

Meffert et al.

[11] Patent Number: 4,930,420

[45] Date of Patent: Jun. 5, 1990

[54] SEAL FOR THE NOZZLE OPENING OF A PROJECTILE

[75] Inventors: Wolfgang Meffert; Kalr-Heinz Silligmann; Siegmar Fischer, all of Düsseldorf; Ulf Hahn, Ratingen, all of Fed. Rep. of Germany

[73] Assignee: Rheinmetall GmbH, Düsseldorf, Fed. Rep. of Germany

[21] Appl. No.: 362,946

[22] Filed: Jun. 8, 1989

[30] Foreign Application Priority Data

Jun. 9, 1988 [DE] Fed. Rep. of Germany ..... 3819640

[51] Int. Cl.[5] ..... F42B 13/02; F42B 13/267; F42B 15/00; F42C 19/08

[52] U.S. Cl. ..... 102/374; 102/490

[58] Field of Search ..... 102/374, 490

[56] References Cited

U.S. PATENT DOCUMENTS 3,044,254 7/1962 Adelman .
3,369,485 2/1968 Jones .
3,754,507 8/1973 Dillinger et al. .

FOREIGN PATENT DOCUMENTS 317724 9/1974 Austria .
180515 5/1986 European Pat. Off. .
2634518 2/1978 Fed. Rep. of Germany .
3248014 7/1984 Fed. Rep. of Germany .

OTHER PUBLICATIONS

"Handbook of Weaponry", 2nd English Edition, 1982, Rheinmetall GmbH, Düsseldorf, pp. 532–537.

*Primary Examiner*—Charles T. Jordan
*Assistant Examiner*—Richard W. Wendtland
*Attorney, Agent, or Firm*—Spencer & Frank

[57] ABSTRACT

A projectile includes a propellant charge and a nozzle opening provided in a rear projectile part and serving as an exit for propellant charge gases during flight of the projectile; a resilient rupturnable rubber or plastic sealing disc closing the nozzle opening for protection against environmental influences.

7 Claims, 1 Drawing Sheet

SEAL FOR THE NOZZLE OPENING OF A PROJECTILE

CROSS REFERENCE TO RELATED APPLICATION

This application claims the priority of Federal Republic of Germany Application No. P 38 19 640.9 filed June 9th, 1988, which is incorporated herein by reference.

BACKGROUND OF THE INVENTION

This invention relates to a projectile which is provided with a propellant charge and a base nozzle from which, after firing the projectile from a weapon tube, hot propellant charge gases exit during the flight. A sealing disc is arranged in the base nozzle for providing a seal against environmental effects while the projectile is in storage.

Projectiles of the above type may be "base-bleed" projectiles having a gas generator to reduce base suction or post-accelerated projectiles with rocket drives, referred to as rocket assisted projectiles (RAP). A post-accelerated projectile is disclosed, for example, in *Handbook on Weaponry*, second English Edition, 1982, page 535, FIG. 1119 (published by Rheinmetall GmbH, Düsseldorf). To attain a greater range, the tail section of such projectiles contains propellant charge which is ignited when the projectile is fired, for example, from a large-caliber weapon, such as a 155 mm or 203 mm gun. Due to the escape of the hot propellant charge gases through the base nozzle, the desired aerodynamic effect is imparted to the projectile, that is, the projectile is post-accelerated during flight and the total resistance is reduced.

To seal such projectiles against environmental influences such as humidity, dust and others, the nozzle openings in the base nozzle of such projectiles are conventionally closed or sealed. For this purpose, for example, threaded plugs made of metal or plastic or pressed-in plugs are used. It is a disadvantage of such plugs that they must be removed manually before the projectile is loaded into the weapon. Also, thin covering sheets made of metal, paper or plastic are known. A sheet metal cover foil disclosed in German Patent Document 3,248,014, preferably provided with predetermined break locations, is, upon firing of the projectile, caused to burst from the outside inwardly into the nozzle openings by the high gas pressure of the propellant gases during the acceleration phase in the gun barrel, thus permitting ignition of the propellant charge base-bleed assembly disposed in the tail section of the projectile.

Such a covering disc whose thickness should be between about 0.5 and 1.0 mm, and which must have an upstanding rim, can be fastened to the projectile by welding, soldering or by clamping by means of a sleeve nut, which are all labor-intensive operations.

Such thin and rigid foils are very sensitive to mechanical stresses, such as pressure or shock, and thus they tend to tear when the projectile is being handled (reloading, transporting) and are therefore no longer able to perform their function of protecting the projectile against environmental influences. Moreover, risks are high that parts of the metal cover disc will bend back into and firmly settle in the nozzle opening after firing and disadvantageously change the diameter of the nozzle opening.

SUMMARY OF THE INVENTION

It is an object of the invention to provide an improved cover for the base nozzles of the above-described projectiles so as to, on the one hand, provide a reliable protection against environmental influences and, on the other hand, permit a reliable firing as well as interference-free burning of the propellant charge in the interior of the projectile.

This object and others to become apparent as the specification progresses, are accomplished by the invention, according to which, briefly stated, the sealing disc in the nozzle opening is composed of a rubber disc firmly secured by vulcanization or a sprayed-in plastic disc. The sealing disc thus advantageously elastically yields to numerous extraneous stresses and bursts open without difficulty when the projectile is fired.

According to a further feature of the invention, in order to improve the securement of the disc within the axially extending wall of the nozzle bore, the sealing disc is thicker in the edge region than in the center.

DESCRIPTION OF THE PREFERRED EMBODIMENTS

Figure 1:
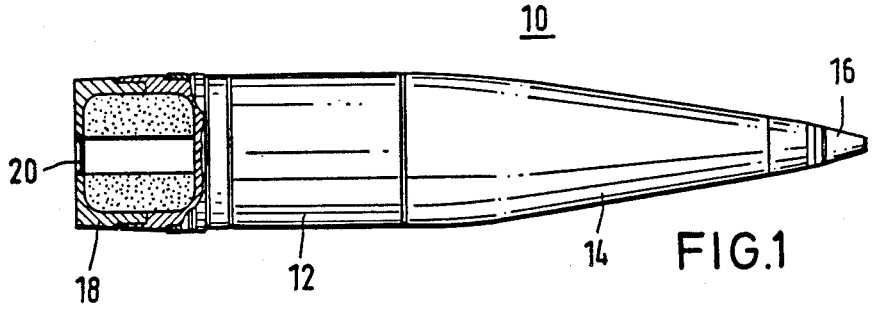
FIG. 1 is a partially sectional side elevational view of an artillery projectile incorporating a preferred embodiment of the invention.

Turning to FIG. 1, the artillery projectile 10 shown therein includes, in its central region, a cylindrical, full-caliber projectile body 12. The projectile tapers toward the front into an ogival part 14 provided with a fuze 16 in its nose.

Figure 2:
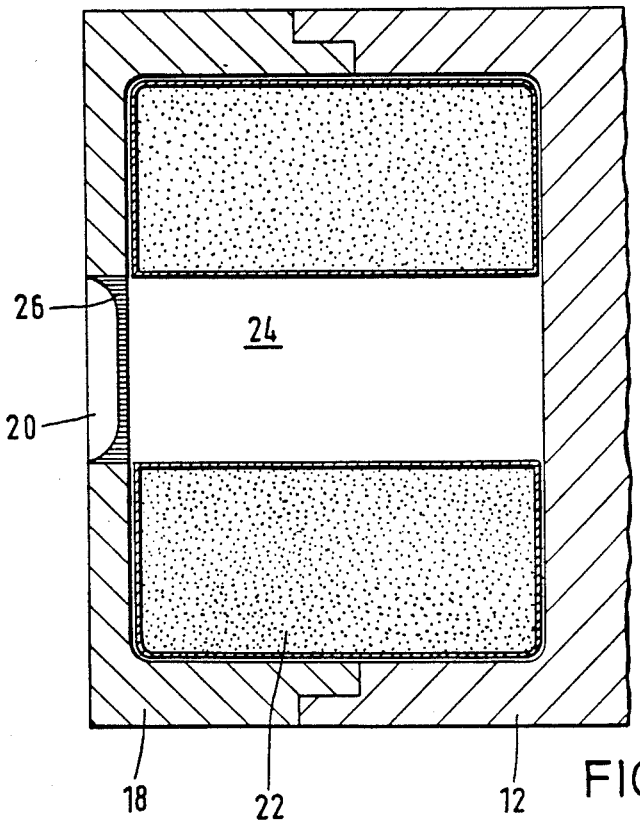
FIG. 2 is an enlarged view of one part of FIG. 1.

Also referring to FIG. 2, at the tail end, a dished base 18 is secured to the projectile body 12 and is provided with a central nozzle opening 20. A propellant charge 22 (base-bleed set) having a central ignition channel 24 is disposed within the projectile.

According to the invention, a resilient sealing disc 26 of rubber or plastic covers the nozzle opening 20 and is firmly secured to the edge region of the base 18 defining the nozzle opening 20. In case of rubber, the sealing disc 20 is affixed by vulcanization and in case of a plastic (such as nylon, polyamide or polyvinyl chloride), the sealing disc is applied by spraying.

To better fasten the sealing disc 20 in nozzle opening 20, its thickness is greater in the circumferential edge zone than in its center.

A method of producing the projectile base 18 and the rubber disc 18 vulcanized into base nozzle 20 includes the following steps:

- the dished base member 18 of the projectile 10 or a nozzle insert member is individually inserted into an appropriate vulcanization device;
- the nozzle opening 20 is closed from the interior of the base member 18 by means of a punch, a disc or the like placed coplanar with the inner radial wall face of the base 18;
- a liquid caoutchouc mixture is filled into the remaining recess in the nozzle opening which corresponds to the wall thickness of the base member 18;
- the caoutchouc mixture is vulcanized under pressure and at an elevated temperature to produce the rubber disc 26; and the base member 18 is fixed to the projectile body 12 after the propelling charge and possibly other internal components (such as an ignition and safety unit or secondary projectiles or the like) are installed therein.

Figure 3:
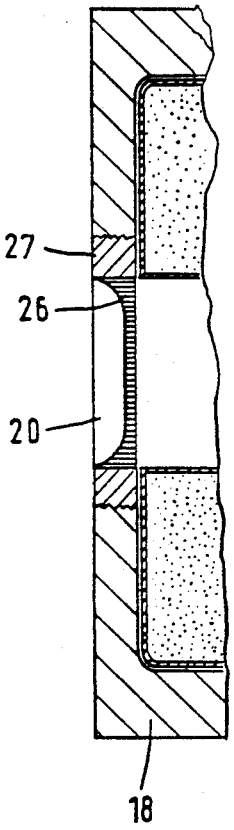
FIG. 3 is a view similar to FIG. 2, showing another preferred embodiment of the invention.

As an alternative, it is feasible to vulcanize the rubber disc into an insert ring 27 which can be subsequently screwed into the nozzle opening 20 as illustrated in FIG. 3.

Plastic discs may be provided in the base member 18 with a similar process, except that they are obtained by spraying, for example, by means of an injection molding apparatus into which the base member is placed.

For the intended purpose, the invention can also be employed for other projectiles or flying bodies (rockets) which have rearward base nozzles and a fuze disposed within the combustion chamber.

It will be understood that the above description of the present invention is susceptible to various modifications, changes and adaptations, and the same are intended to be comprehended within the meaning and range of equivalents of the appended claims.

What is claimed is:

1. In a projectile including a propellant charge and a nozzle opening provided in a rear projectile part and serving as an exit for propellant charge gases during flight of the projectile; a rupturable sealing disc closing the nozzle opening for protection against environmental influences; the improvement wherein said sealing disc is resilient and is of a material selected from the group consisting of rubber and plastic; further wherein said sealing disc has a circumferential marginal zone and a center zone and is attached to said rear projectile part; said circumferential marginal zone having a greater thickness than that of said center zone.

2. A projectile as defined in claim 1, wherein said rear projectile part comprises a base member, and further wherein said sealing disc is bonded to said base member.

3. A projectile as defined in claim 1, further comprising an externally threaded support ring; said rear projectile part having, in an edge zone about said nozzle opening, a threaded portion threadedly engaging said externally threaded support ring; said sealing disc being bonded to said support ring.

4. A projectile as defined in claim 1, wherein said sealing disc is affixed to a disc support.

5. A projectile as defined in claim 4, wherein said sealing disc is of rubber and is affixed to said disc support by vulcanization.

6. A projectile as defined in claim 4, wherein said sealing disc is of plastic and is affixed to said disc support by being sprayed thereonto.

7. A projectile as defined in claim 4, wherein said disc support is constituted by said rear projectile part.

* * * * *